US009290306B2

(12) United States Patent
Totten

(10) Patent No.: US 9,290,306 B2
(45) Date of Patent: Mar. 22, 2016

(54) TAMPER EVIDENT CLOSURE FOR FLEXIBLE CONTAINERS

(71) Applicant: Kevin Totten, South Elgin, IL (US)

(72) Inventor: Kevin Totten, South Elgin, IL (US)

(73) Assignee: Hoffer Plastics Corporation, South Elgin, IL (US)

( * ) Notice: Subject to any disclaimer, the term of this patent is extended or adjusted under 35 U.S.C. 154(b) by 0 days.

(21) Appl. No.: 14/199,198

(22) Filed: Mar. 6, 2014

(65) Prior Publication Data

US 2014/0263475 A1 Sep. 18, 2014

Related U.S. Application Data

(60) Provisional application No. 61/779,368, filed on Mar. 13, 2013.

(51) Int. Cl.
*B67B 1/00* (2006.01)
*B65D 41/34* (2006.01)

(52) U.S. Cl.
CPC ..... *B65D 41/3409* (2013.01)

(58) Field of Classification Search
CPC ..... B65D 47/122; B65D 1/023; B65D 2101/0023; B65D 25/48; B65D 41/3409; A61J 1/10
USPC ..... 222/153.14
See application file for complete search history.

(56) References Cited

U.S. PATENT DOCUMENTS

| | | | | |
|---|---|---|---|---|
| 5,819,965 | A * | 10/1998 | King et al. | 215/252 |
| 6,173,853 | B1 * | 1/2001 | Luch | 215/256 |
| 6,435,383 | B1 * | 8/2002 | Lee | 222/522 |
| 6,571,995 | B2 * | 6/2003 | Lee | 222/527 |
| 8,033,419 | B1 * | 10/2011 | Szekely | 220/714 |
| 2003/0071007 | A1 * | 4/2003 | Ma et al. | 215/252 |
| 2006/0249474 | A1 * | 11/2006 | Sawyer et al. | 215/256 |
| 2011/0024423 | A1 * | 2/2011 | Erspamer et al. | 220/266 |
| 2013/0240573 | A1 * | 9/2013 | Debski | 222/438 |

* cited by examiner

*Primary Examiner* — Patrick M Buechner
*Assistant Examiner* — Jeremy W Carroll
(74) *Attorney, Agent, or Firm* — Knechtel, Demeur & Samlan

(57) ABSTRACT

A closure for flexible containers or pouches that contain food products that provides at least two visual indicators showing that the cap has been partially or totally unscrewed from the spout. The first indicator is a tab in a window section of the cap that has its mounting filaments or bridges broken when the cap is unscrewed. These filaments or bridges connect the tab to the top portion of the cap. The second indicator is a vertical break or rupture line in the tab that indicates that the tab has been bent to rupturing.

16 Claims, 10 Drawing Sheets

TAMPER EVIDENT CLOSURE FOR FLEXIBLE CONTAINERS

CROSS-REFERENCE TO RELATED APPLICATIONS

This application is based on and claims priority of provisional patent application 61/779,368 filed Mar. 13, 2013.

BACKGROUND AND SUMMARY OF THE INVENTION

This invention relates to closures for use in flexible containers or pouches that generally contain food products.

Various closures have been used for sealing flexible pouches containing liquids, pastes, gels and similar products. Some closures are designed for single use, meaning that once the closure is opened or removed, the contents are to be fully consumed and the closure is not designed to be placed back on the opening or spout. In the other instance, the closure is designed to re-seal the opening and to preserve the contents remaining in the pouch.

In either instance, the closure presents a potential safety issue. In some prior art devices, when the top or cap is removed, the closure leaves a band around the opening or spout. Children can attempt to remove it with their teeth, or the band can sometimes be easily pulled off. The band may be swallowed or worse, presents a choking hazard. Applicant's invention provides a removable top or cap that, when removed from the spout, leaves no band around the spout.

Another problem with past closures is that if they are designed to re-seal the container, there is often no visual indication the cap was partially or completely removed and then placed back onto the spout. This again presents a safety hazard as one would want to know if the contents are fresh or have been exposed to the atmosphere or, even worse, if the contents of the pouch have been tampered with.

Applicant's invention provides a means by which there is visual indication that the cap has been removed and then placed back onto the spout. There are two visual indicators indicating that the top has been partially or completely removed and replaced. The first indicator is a tab in a window section of the cap that has its mounting filaments or bridges broken when the cap is unscrewed. These filaments or bridges connect the tab to the top portion of the cap. The second indicator is a vertical break or rupture line in the tab that indicates that the tab has been bent to rupturing, indicating that the top of the cap has been unscrewed.

OBJECTS AND ADVANTAGES

It is an object of applicant's invention to provide a safe and secure closure for flexible containers. A related object is to provide a closure that gives a visual indication if the top has been partially or totally removed from the closure. A related object is to provide at least two visual indicating means for indicating that the cap has been unscrewed from the closure with at least one of the indicating means not requiring that the cap be completely removed from the closure. It is yet another object to provide a cap that when removed from the closure does not leave a ring around the closure that can be removed by a child which will otherwise present a safety hazard.

An advantage of Applicant' safety closure is that it provides two visual indicators or partial or total removal of the cap from the closure. It also reduces the risk of a child choking on a ring left on the closure that can be dislodged or removed by a child.

DESCRIPTION OF THE PREFERRED EMBODIMENT

Figure 1:
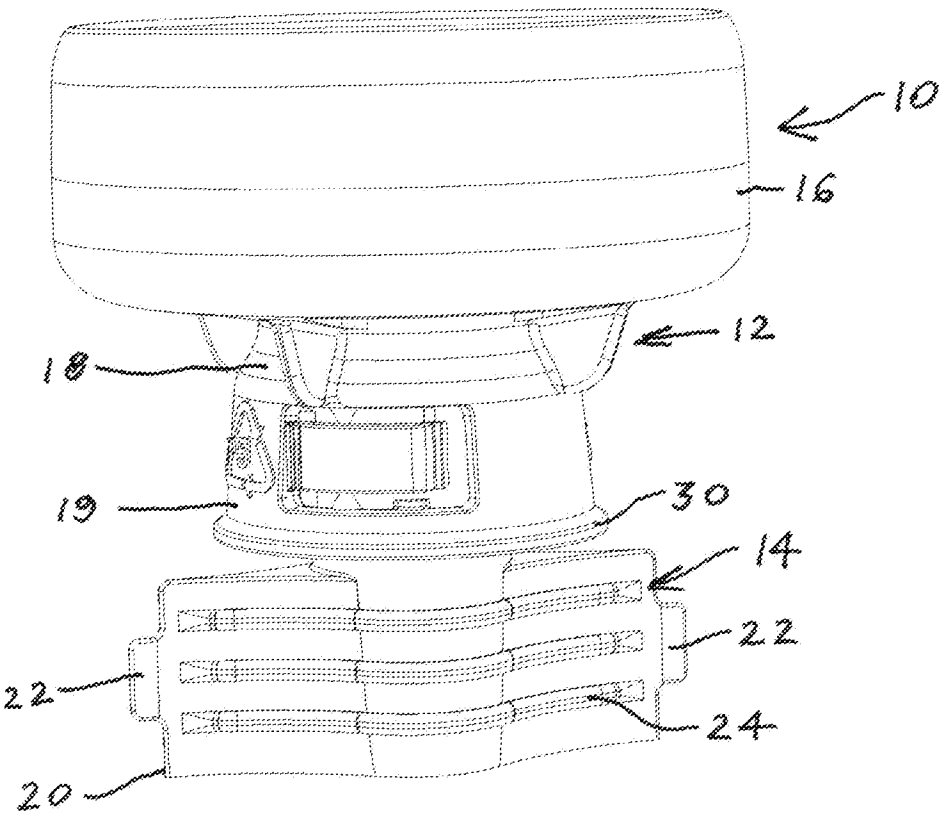
FIG. 1 is a front elevation view of a first embodiment of the closure with the cap secured to the spout.

Turning first to FIG. 1, there is illustrated one embodiment of the invention. A tamper evident closure 10 is illustrated that is designed to be used on flexible containers such as pouches and the like that contain liquid, gel or paste type food products. The closure 10 is comprised of a cap 12 and a spout 14. The cap 12 and spout 14 are generally manufactured from a high density polyethylene thermoplastic material that can be injection molded. Other similar materials can be used that meet the specifications and purpose of the closure 10. Particularly if the container is to contain a food product, the materials from which the closure 10 is manufactured must be approved for food consumption. The cap 12 has a bell or top 16 that is the portion grasped by the person that intends to open the closure 10 to access the contents of the pouch. Below the top 16 is the mid section 18 and below that is the lower section 19 that fits over the spout 14.

The spout 14 as seen in FIG. 1 has a spout bottom 20 with an opposite pair of extending wings 22. There are horizontally parallel ribs 24 on the spout bottom that extend out along the wings 22. When the spout bottom 20 is inserted into the top of the flexible pouch (not illustrated) the spout bottom is sealed to the interior walls of the pouch and the ribs assist in maintaining a safe, secure and waterproof fit.

Figure 2:
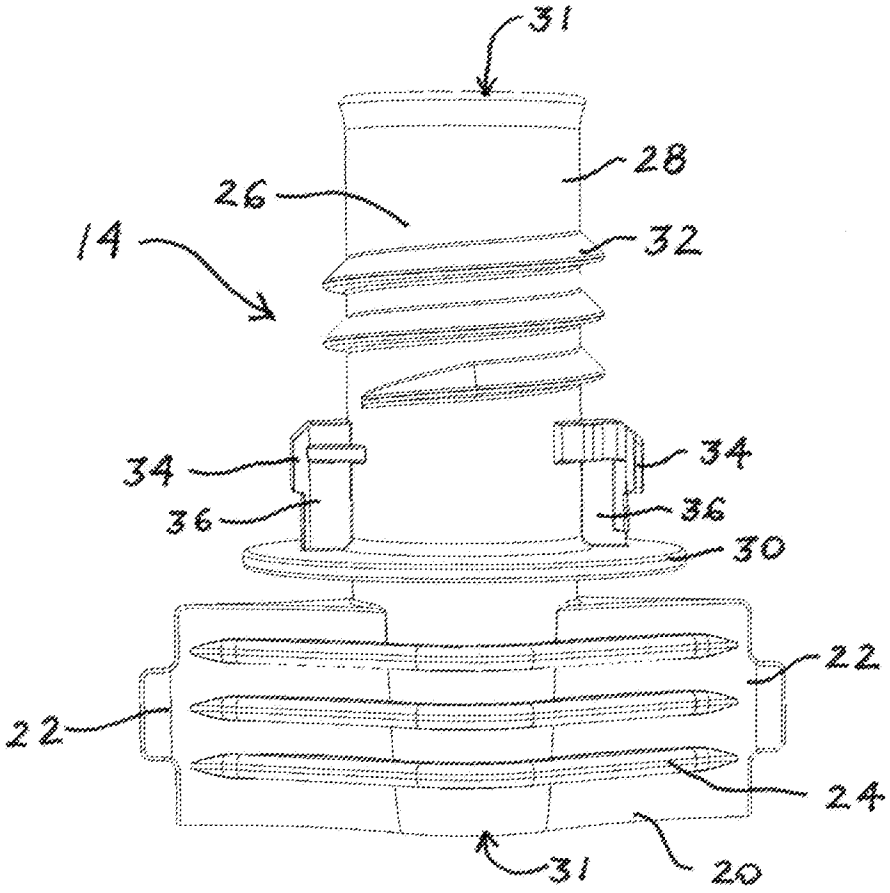
FIG. 2 is a front elevation view of the spout with the cap removed.
Figure 3:
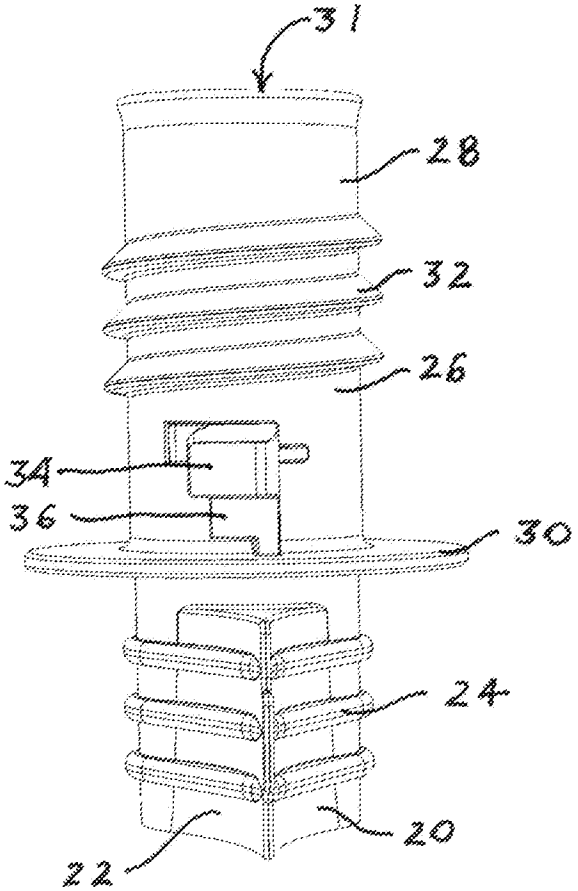
FIG. 3 is a side elevation view of the spout with the cap removed.
Figure 4:
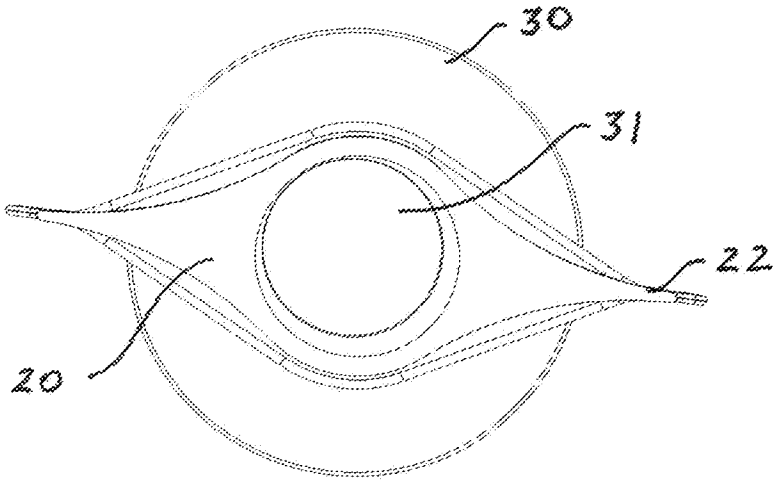
FIG. 4 is a bottom view of the spout.
Figure 10:
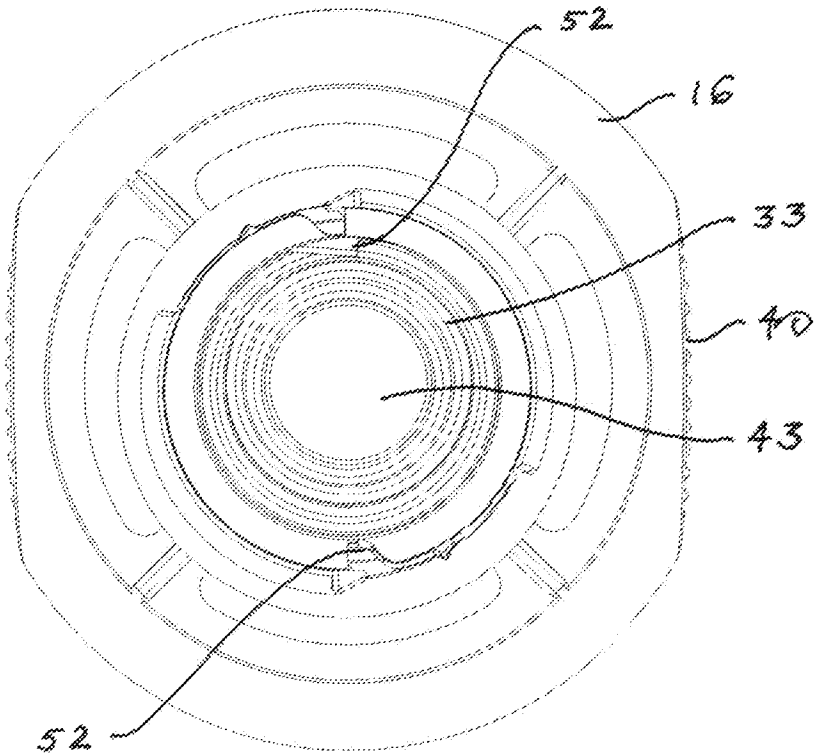
FIG. 10 is a bottom view of the second embodiment of the cap.

The details of the spout 14 are more clearly illustrated in FIGS. 2 and 3 where the cap 12 is removed from the spout 14. There is a centrally disposed tube 26 that extends from a spout top 28 through a collar 30 and then through the spout bottom 20. The tube 26 has a hollow fluid passageway 31 passing through it, through the collar 30 and through the spout bottom 20 so that the fluid or contents in the pouch can pass through the fluid passageway 31 from the pouch to the spout top 28. There are external threads 32 around the spout top 28 and central tube 26 so that the cap 12 can be screwed onto the central tube 26. To accomplish this, the cap 12 has complementary internal receiving threads 33 (as seen in FIG. 10).

Figure 5:
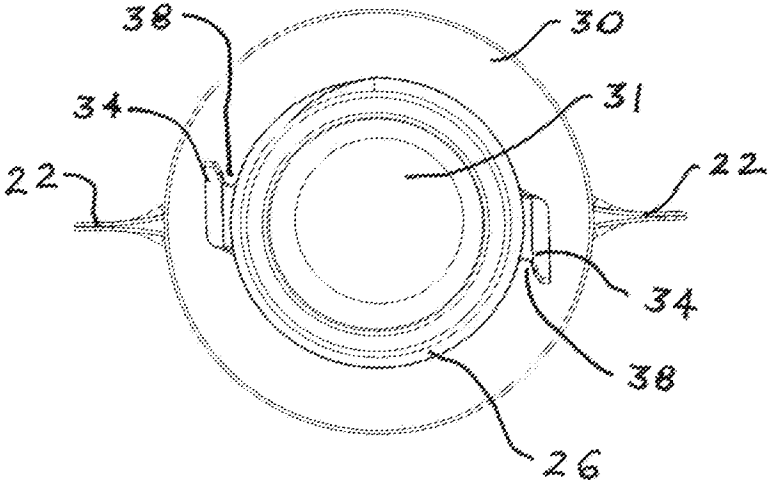
FIG. 5 is a top view of the spout.

In FIG. 2 there can also be seen a pair of fingers 34 that extend out from the central tube 26. The fingers 34 are molded to the central tube 26 and to the top of the collar 30 by means of finger reinforcing ribs 36. The reinforcing ribs 36 provide additional structural support for the fingers 34. As more clearly seen in FIG. 5 the fingers 34 protrude out from the central tube 26 to create a catch, hook or u-shaped cup 38 between the finger 34 and the central tube 26. The distal end of the finger 34 opposite the proximal end of the finger attached to the central tube 26 is in a plane that would be substantially tangential to the central tube 26 of the finger was touching the central tube 26. The purpose of the catch, hook or cup 38 will be described below.

FIGS. 6-10 illustrate an alternate embodiment of the cap 12 which has a modified top section or bell 16. This embodiment is identical to the first embodiment illustrated in FIG. 1 except that there a pair of flats 40 located on either side of the top section 16. The flats 40 serve two functions. The first is they assist the user in grasping the top section 16 to twist it off from the closure 10. The second is that they provide a positioning mechanism utilized during assembly of the closure allowing automated equipment to position the cap 12 precisely each time for assembly to the spout 14. This allows the threads 32 and 33 to be correctly oriented relative to each other for the cap 12 to be screwed onto the spout 14.

Figure 9:
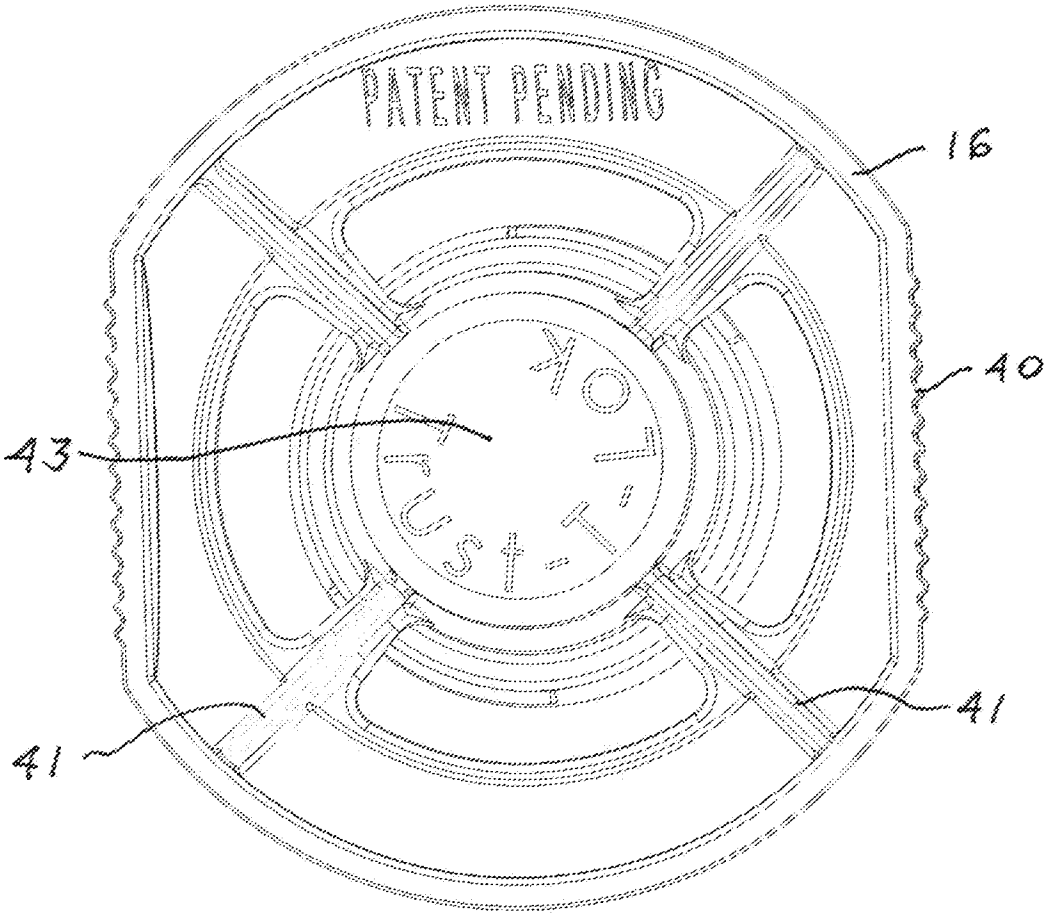
FIG. 9 is a top plan view of the second embodiment of the cap.

As seen in FIG. 9, the top 16 has internal top supports 41 that assist in giving structural strength to the top 16. Covering the top end of the top 16 is a covering 43. The covering 43 covers and seals in a fluid tight seal the top of the fluid passageway 31 when the top 16 is screwed onto the spout 14.

Figure 6:
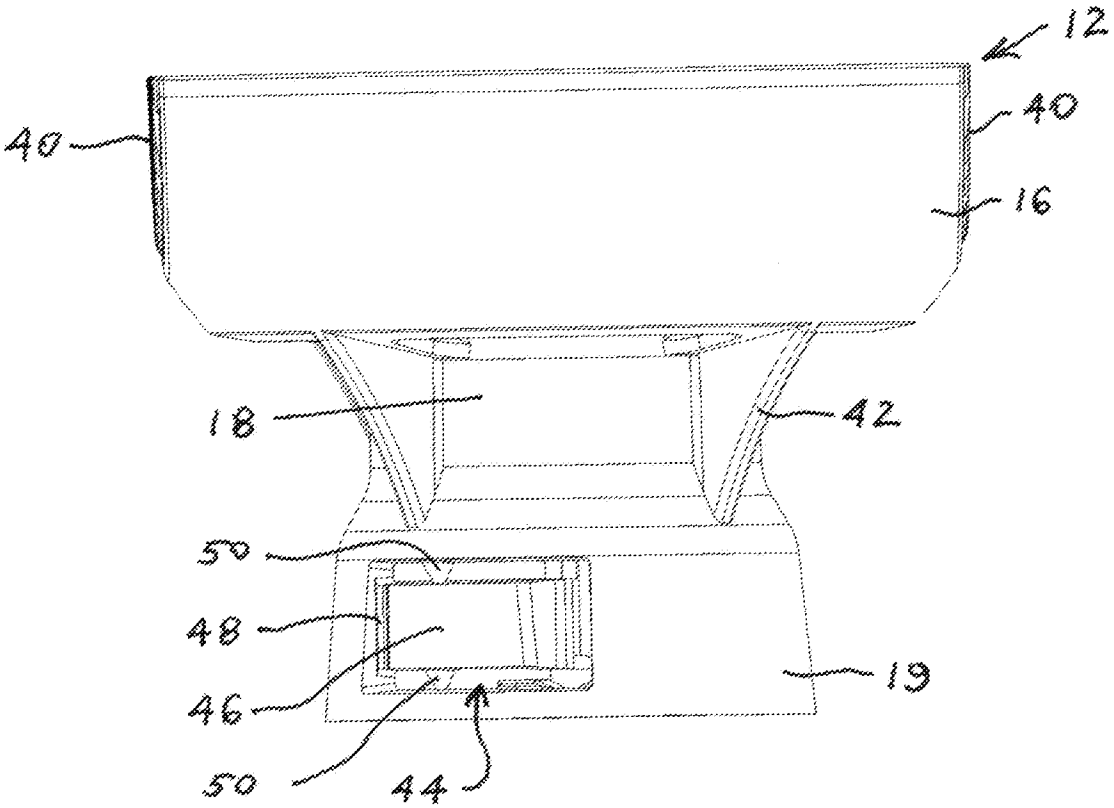
FIG. 6 is a front elevation view of a second embodiment of the cap having been removed from the spout.
Figure 7:
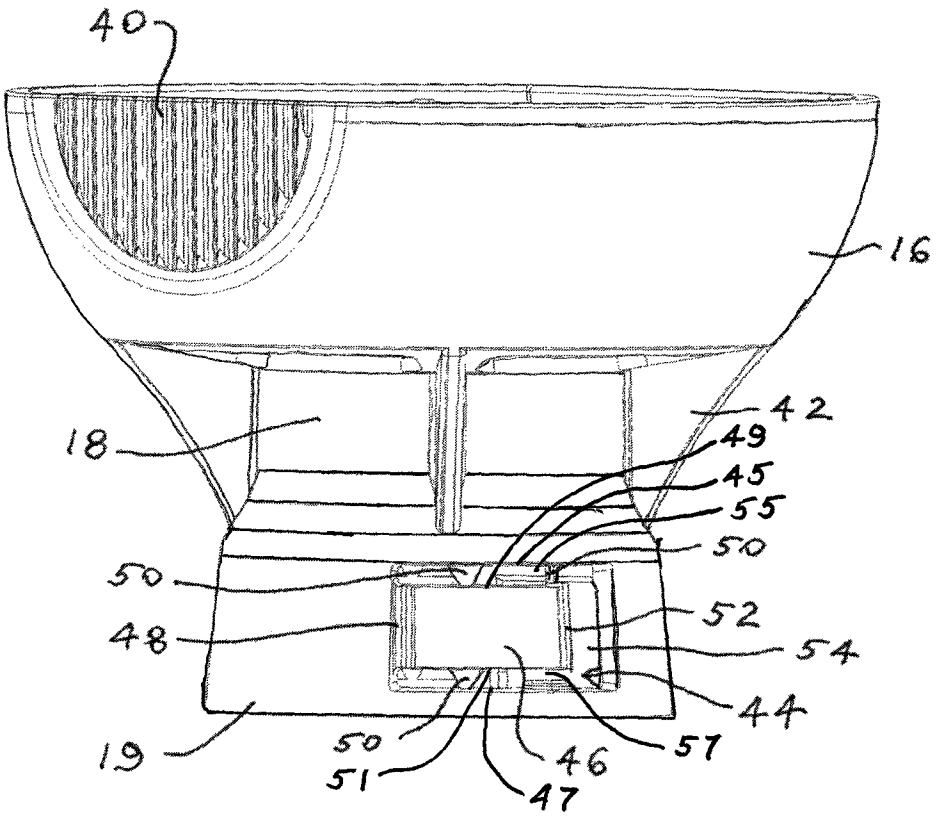
FIG. 7 is a front elevation view of the cap of FIG. 6 excepted rotated approximately 30° counter clockwise.
Figure 8:
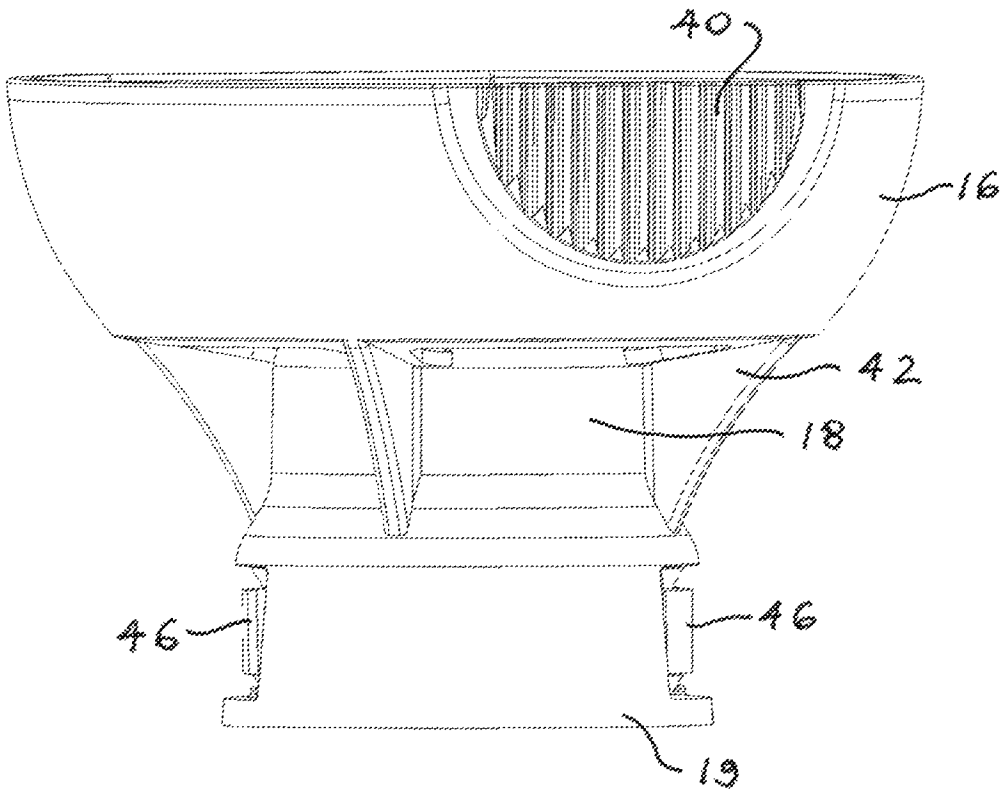
FIG. 8 is a side elevation view of the cap illustrated in FIG. 6 showing the side view of the two tamper evident windows.

As seen in FIG. 6, below the top 16 is the mid section 18 which has reinforcing ribs 42 placed between the mid section 18 and the underside of the top 16. This provides structural support for the top 16 so that it is securely attached to the mid section and lower section 19.

The lower section 19 provides the visual indication of tampering with the closure 10 or if the cap 12 has been removed or unscrewed from the spout 14. As most clearly seen in FIGS. 6 and 7 there is an opening or window 44 formed in the lower section 19. A tab 46 is secured to one side of the window 44 by means of a living hinge 48. The window 44 has a top wall 45 and a bottom wall 47. The tab 46 has a tab top 49 and a tab bottom 51. Three thin filaments or bridges 50 keep the tab 46 in place substantially in the same vertical plane as the plane of the wall of the lower section 19. The bridges 50 connect the top wall 45 of the lower section 19 to the tab top 49 and the bottom wall 47 to the tab bottom 51. There is a leading edge 52 of the tab 46 opposite the hinge end of the tab 46. The leading edge 52 is separated by a gap 54 from the other side of the window 44 opposite the hinge 48. There is a top gap 55 between the top wall 45 and the tab top 49 which is traversed by the bridge 50 and a bottom gap 57 between the bottom wall 47 and the tab bottom 51 which is similarly traversed by another bridge 50.

To use the closure 10, the user grasps the top 16 and rotates it counter clockwise, in the normal motion one uses to unscrew a cap from any bottle. If the cap 12 has the pair of flats 40, it is easier for the user to grasp and turn the cap 12. As the cap 12 is rotated, the leading edge 52 of the tab 46 slides into the hook 38 (FIG. 5) formed by the finger 34. It is important to note that the position of the tab 46 with respect to the hook 38 is such that the leading edge 52 engages the hook 38 in approximately the first third (i.e. 120°) of the turn of the top 16. As the cap rotates, the tab 46 is pushed into the hook 38 causing the filaments 50 to rupture and the tab 46 to buckle generally around its mid point. Preferably this occurs before the covering 43 separates from the top of the fluid passageway 31. In this manner the fluid tight seal between the covering 43 and the tube 26 is intact even though there is evidence of physical tampering with the closure 10. Once the tab 46 buckles and the filaments 50 rupture, the cap 12 can be freely twisted off from the spout 14. However, when the tab buckled, it creates a white line in the plastic at the point where it buckled. This is a physical characteristic of plastics and gives a visual indication that the cap has been twisted a sufficient amount to cause the tab 46 to buckle. Depending on the position of the tab 46 and the hook 38, the tab 46 may buckle before the bridges 50 rupture, which still gives the user a visual indication that the cap 12 has been rotated. The second visual indication that the cap 12 has rotated, is that the filaments or bridges 50 will break which gives the second visual indication that the cap 12 has been unscrewed from the spout 14. Lastly, and a third visual indication is that the gap 54 in the window 44 will be larger due to the tab 46 being folded over upon itself and buckled at its center.

The cap 12 can still be screwed back onto the spout 14 even though the tab 46 has buckled and the filaments 50 ruptured. Thus the cap 12 is re-sealable onto the spout 14; however, there is visible evidence that the cap 12 has been removed from the spout 14 so that the person using the food or liquid in the pouch is aware that the closure 10 has been opened.

Thus there has been provided a tamper evident closure for flexible containers that fully satisfies the objects set forth above. While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A closure for a container comprising:

a spout with a top and bottom portion and a central passageway through which a food product can pass from the container through the spout, the bottom portion of the spout engaging the container in a fluid tight seal around an exterior surface of the bottom portion, the top having external threads on the central passageway, a cap having a top portion and a bottom portion, with the bottom portion having an outer wall, an open bottom and the top portion having a closed top, the cap having a central passageway with internal threads, an opening located in the outer wall of the bottom portion of the cap, the opening having opposite sides and a top and a bottom, a tab having opposite ends, one end being a proximal end and the opposite end being a distal end, with the proximal end hingedly attached to one side of the opening and the distal end adjacent to but unattached to the opposite side of the opening, a finger extending outward from the central passageway, the distal end engaging the finger in an interfering engagement when the cap is rotated in a cap releasing direction causing the tab to buckle when the cap is rotated with sufficient force to overcome the resistance of the tab, the tab creating a visual indicator that the tab has buckled as a result of the cap being rotated, the tab remaining attached to the one side of the opening in the outer wall after the cap has been rotated in the cap releasing direction.

2. The closure of claim 1 and further comprising at least one filament connected to the top or bottom of the opening and the tab, the filament rupturing when the cap is rotated with sufficient force to overcome the resistance of the filament, the ruptured filament forming a visual indication that the cap has rotated a sufficient distance to overcome the resistance of the filament attached to the top or bottom and the tab and thereby rupture the connection between the filament and the tab.

3. The closure of claim 1 wherein the opening is rectangular with opposite sides, a top and a bottom, the proximal end of the tab hingedly attached to one side and the distal end adjacent to but unattached to the opposite side, at least one filament connected to the top or bottom of the opening and the tab, the filament rupturing when the cap is rotated with sufficient force to overcome the resistance of the filament, the ruptured filament forming a visual indication that the cap has rotated a sufficient distance to overcome the resistance of the tab and the filament attached to the top or bottom and the tab and thereby cause the tab to buckle and the filament to rupture.

4. The closure of claim 1 wherein the finger extends from the central passageway and forms a hook that engages the distal end of the tab when the cap is rotated.

5. The closure of claim 1 wherein the closed top engages the top portion of the spout in sealing engagement when the cap is securely screwed onto the central passageway of the spout.

6. The closure of claim 1 wherein the distal end of the tab slides over the finger in a non interfering engagement when the cap is rotated in a cap tightening direction.

7. The closure of claim 1 wherein the top portion of the cap further comprises opposite flat portions for ease of grasping and twisting the cap.

8. A closure for a container comprising:

a spout with a top and bottom portion, a cap having a side wall, an open bottom and a closed top, the top having internal threads, a central passageway extending from the bottom to the top of the spout for transporting a food product from the container through the spout, the bottom portion of the spout having an exterior portion around the central passageway to engage the container in a fluid tight seal, the top having external threads on the central passageway, a finger extending outward from the central passageway, the finger having a proximal end connected to the central passageway, and a distal end, the distal end forming a catch for receiving the tab when the cap is rotated in the cap releasing direction, an opening located in the side wall of the cap, the opening in the side wall having opposite sides, a top and a bottom, a tab having opposite ends, with a hinged end hingedly attached to one side of the opening and the opposite end being a free end adjacent to the opposite side of the opening, the free end being received in the catch when the cap is rotated in the cap releasing direction causing the tab to buckle when the cap is rotated with sufficient force to overcome the resistance of the tab, the tab forming a visual indication that the tab has buckled as a result of the cap being rotated.

9. The closure of claim 8 and further comprising at least one filament connected to the top or bottom of the opening and the tab, the filament rupturing when the cap is rotated a predetermined distance giving a visual indication that the cap has rotated a sufficient distance to cause the filament to rupture.

10. The closure of claim 8 wherein the closed top engages the top of the spout in sealing engagement when the cap is securely screwed onto the central passageway of the spout.

11. The closure of claim 8 wherein the free end of the tab slides over the finger in a non interfering engagement when the cap is rotated in a cap tightening direction.

12. The closure of claim 8 wherein the top portion of the cap further comprises opposite flat portions for ease of grasping and twisting the cap.

13. A closure for a container comprising:

a spout with a top and bottom portion and a central passageway extending from the bottom to the top of the spout for transporting a food product from the container through the spout;

a member extending out from the central passageway, the member having a proximal end attached to the central passageway and a distal end opposite the proximal end, a catch at the distal end of the member, a cap having a side wall with an opening in the side wall, the opening having opposite sides, a top and a bottom, a tab having opposite ends, with a hinged end hingedly attached to one side of the opening and the opposite end being a free end, the free end being received in the catch when the cap is rotated in a cap releasing direction causing the tab to buckle when the cap is rotated with sufficient force against the catch forming a visual indication that the tab has buckled as a result of the cap being rotated.

14. The closure of claim 13 and further comprising at least one filament connected to the top or bottom of the opening and the tab, the filament rupturing when the cap is rotated a predetermined distance giving a visual indication that the cap has rotated a sufficient distance to cause the tab to buckle and the filament to rupture.

15. The closure of claim 14 wherein the free end of the tab slides over the finger in a non interfering engagement when the cap is rotated in a cap tightening direction.

16. The closure of claim 15 wherein the top portion of the cap further comprises opposite flat portions for ease of grasping and twisting the cap.

* * * * *